US005329674A

United States Patent [19]

Tomita et al.

[11] Patent Number: 5,329,674

[45] Date of Patent: Jul. 19, 1994

[54] SLIDER FOR SLIDE FASTENER WITH AUTOMATIC STOP MEANS

[75] Inventors: Tsutomu Tomita; Hideo Takabatake, both of Toyama, Japan

[73] Assignee: Yoshida Kogyo K.K., Tokyo, Japan

[21] Appl. No.: 53,192

[22] Filed: Apr. 28, 1993

[30] Foreign Application Priority Data

Apr. 30, 1992 [JP] Japan ..... 4-111796

[51] Int. Cl.[5] ..... A44B 19/00

[52] U.S. Cl. ..... 24/418; 24/387; 24/421

[58] Field of Search ..... 24/418, 419, 421, 429, 24/387

[56] References Cited

U.S. PATENT DOCUMENTS 2,657,445 11/1953 Weber ..... 24/421
4,409,705 10/1983 Yuunaga ..... 24/418
4,768,263 9/1988 Fukuroi et al. ..... 24/418

FOREIGN PATENT DOCUMENTS 0970537 7/1975 Canada ..... 24/421
1094683 5/1959 Fed. Rep. of Germany .
2301951 7/1974 Fed. Rep. of Germany ..... 24/421
372624 5/1959 Switzerland .
394678 10/1962 Switzerland .

*Primary Examiner*—Victor N. Sakran
*Attorney, Agent, or Firm*—Hill, Steadman & Simpson

[57] ABSTRACT

A slider with an automatic stop function for a linear slide fastener in which leg portions of the fastener elements are covered with blades and the like. A slider body comprises an upper wing and a lower wing which are interconnected by a guide post. A narrow linear rib is provided on the inner face of the upper wing to guide edges of blades for covering leg portions of fastener elements and to slide on the upper faces of the coupling head portion of the fastener elements. Pressure lands are provided at a lower height than the rib on both sides of the rib in the neighborhood of the guide post and slide along the blades being pressed against the fastener elements. A leaf spring with an automatic stop function is disposed on the surface of the upper wing so that the tip end thereof serves as stop claw. The stop claw is inserted into the middle portion of the linear rib and the pressure lands to stop the sliding of the slider automatically.

6 Claims, 4 Drawing Sheets

SLIDER FOR SLIDE FASTENER WITH AUTOMATIC STOP MEANS

BACKGROUND OF THE INVENTION

1. Field of the Invention

This invention relates to a slider for a slide fastener having an automatic stop means in a covered slide fastener which is provided with cover parts such as blades, sewing threads, or fastener tapes for covering leg portions of linear fastener elements substantially completely.

2. Prior Art

A slider having an automatic stop means in a conventional linear slide fastener has been proposed in Japanese Utility Model Laid-Open application No. S57-7313 (U.S. Pat. No. 4,409,705), wherein a pressure land for pressing coupling portions of fastener elements are protruded in a central longitudinal direction on an inner face of an upper wing of a slider body, whereby a generally Y-shaped guide channel is formed to prevent threads sewed to the leg portions of the fastener elements from wearing away due to sliding of the slider and to insert an automatic stop claw for stopping the slider among the coupled and exposed right and left fastener elements.

In other known sliders for linear slide fasteners having automatic stop means, the automatic stop claw is inserted among the coupled right and left fastener elements, whereby a claw opening is arranged on the outlet side on a relatively wide linear rib in a center portion of an upper wing of a slider body, that is, the claw opening is punched in the linear rib in the area where flanges on both sides of the slider body are parallel.

Since the above-mentioned and other known sliders for slide fasteners having the automatic stop means may be applied to a slide fastener chain wherein leg portions of right and left fastener elements are attached to the fastener tapes, a stop claw is inserted into the area wherein right and left fastener elements are mutually engaged and exposed on the tapes.

Accordingly, the slider having the automatic stop means had not been used nor disclosed in the past in the covered slide fastener wherein the leg portions of the fastener elements are wholly covered with blades, sewing threads, or fastener tapes without exposing the fastener elements when the linear right and left fastener elements are mutually engaged.

SUMMARY OF THE INVENTION

This invention is therefore intended to solve the above-mentioned problems and it is an object of this invention to provide a novel slider for a covered linear slide fastener having automatic stop function which permits automatic stopping of the slider, wherein fastener elements are not apparent when the right and left fastener elements are mutually engaged because leg portions of the fastener elements are wholly covered with cover parts such as blades, sewing threads, or fastener tapes.

Means for accomplishing the above-mentioned object are as follows; A slider having an automatic stop means in a linear slide fastener with covered leg portions of fastener elements comprises a linear rib being protruded in a central longitudinal direction on an inner face of an upper wing, pressure lands being disposed on both sides of the linear rib in the neighbourhood of a guide post or spacer and at a lower height than the linear rib, and an opening for an elastic automatic stop claw being punched in the mediate portion of the linear rib and the both pressure lands.

Further, the slider for the slide fastener having the automatic stop means is characterized in that the opening for the automatic stop claw is punched in the position where the stop claw will be inserted into a gap between the fastener elements not engaged and immediately before mutually engaged right and left fastener elements in a slider body. Furthermore, the slider having the automatic stop means is characterized in that the pressure lands provided in the slider body are pressed against the cover part covering the leg portions of the fastener elements, the linear rib on the inner face of the upper wing is pressed against the upper faces of the coupling head portions of the fastener elements, and the linear rib is pressed against the lower faces of the coupling head portions of the fastener elements and protruded in the central longitudinal direction on the inner face of the lower wing.

A slider having an automatic stop means for a linear slide fastener according to this invention is set in a slide fastener chain of covered fastener elements. In operation, this slider is slid to carry out the opening operation of the slide fastener chain. Then, when this slider is stopped on the way of opening the slide fastener chain, a resilient stop claw provided in the slider is automatically inserted into a gap of fastener elements not engaged and immediately before the mutually engaged right and left fastener elements, so that the slide fastener chain will not open further.

To open the slide fastener chain, the stop claw inserted into the gap portion of the fastener elements is pulled up from the fastener elements by a pull tab so that the slider can slide to carry out the opening operation.

DETAILED DESCRIPTION OF THE PREFERRED EMBODIMENT

Figure 1:
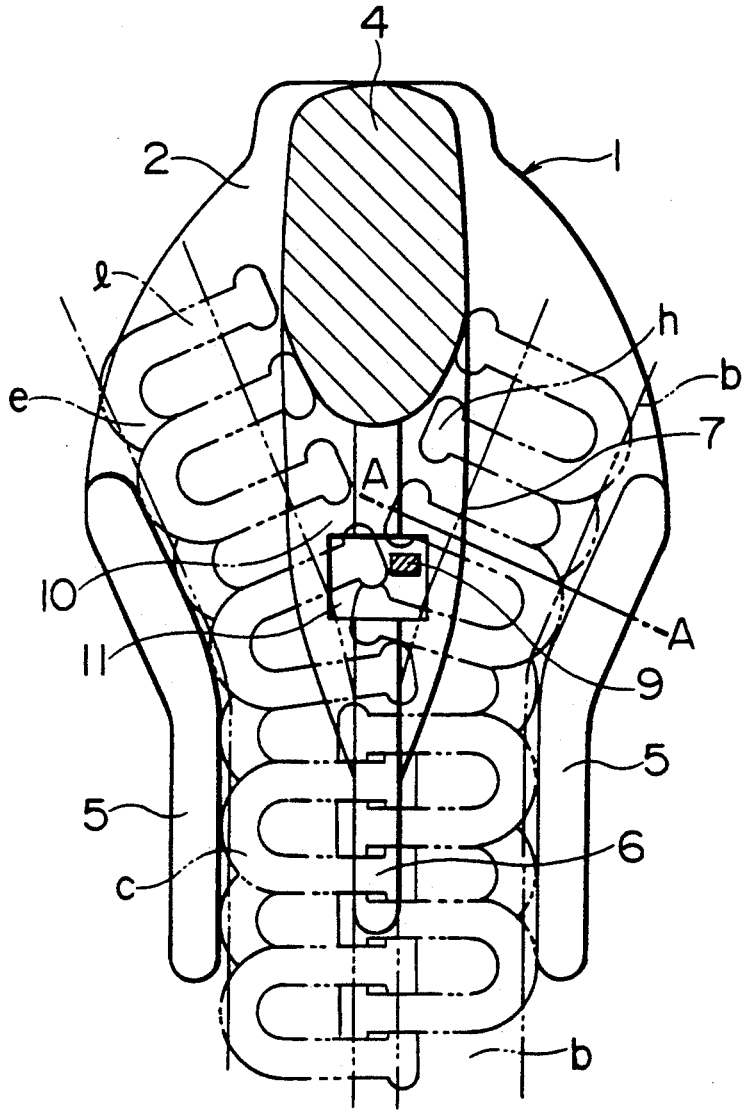
FIG. 1 is a sectional back face view of a slider in a zigzag type linear slide fastener.
Figure 2:
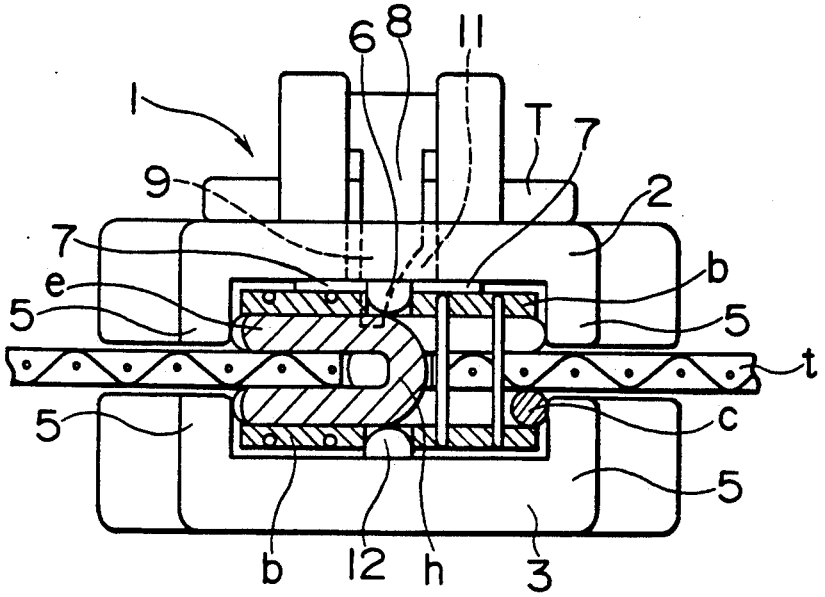
FIG. 2 is a front view of the slider.
Figure 3:
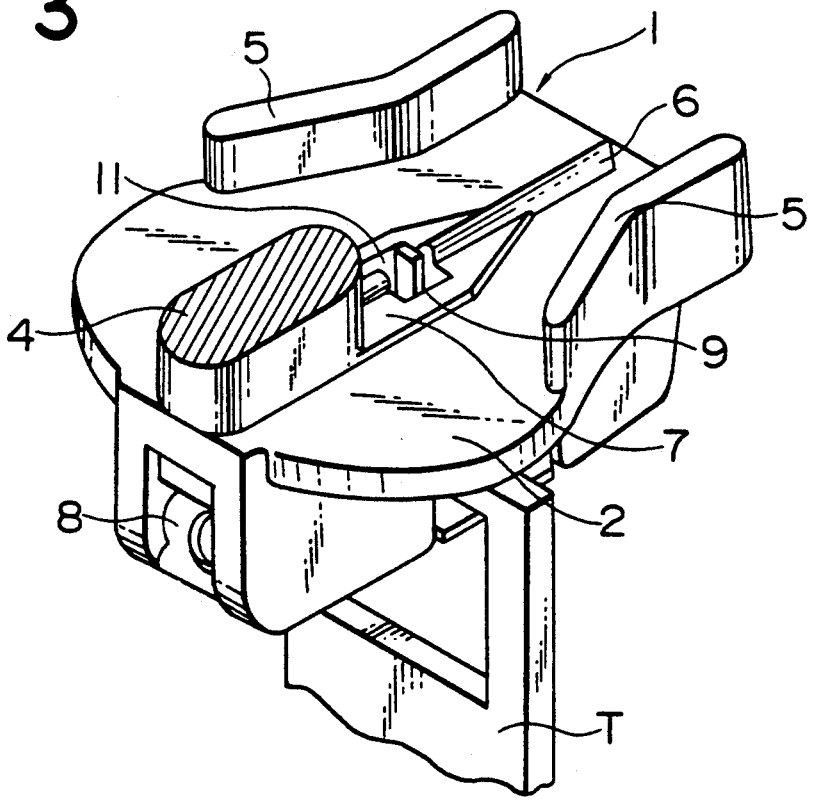
FIG. 3 is a sectional perspective view of the slider.
Figure 4:
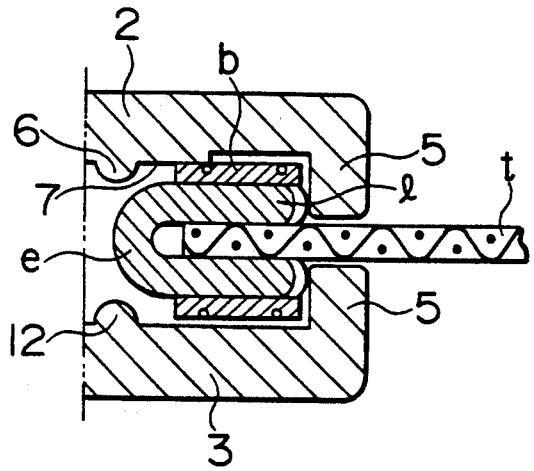
FIG. 4 is an end face view of A—A line in FIG. 1.

Preferred embodiments of this invention will be described in detail with reference to the accompanying drawings.

A zigzag type slider for a linear slide fastener according to this invention is shown as a first embodiment in FIG. 1 to FIG. 4. In the slide fastener chain, zigzaging linear fastener elements e are attached to each one end of fastener tapes t, and leg portions l of the fastener elements e are covered with blades and the like and sewed with threads to form cover parts b, so that coupling head portions h of the right and left fastener elements e are mutually engaged to close the slide fastener chain.

A slider used in this slide fastener chain includes a slider body 1 having an upper wing 2 and a lower wing 3 which are interconnected by a guide post or spacer 4, and the upper wing 2 and lower wing 3 respectively have a pair of flanges 5 projected from both side edges thereof to guide connecting portions c of the fastener elements e. A narrow linear rib 6 is protruded from an inner face of the upper wing 2 to guide edges of cover parts b such as blades and the like covering the leg portions l of the fastener elements e, and is pressed against the upper faces of the coupling head portions h of the fastener elements e to be able to slide. Pressure lands 7 are provided on both sides of the linear rib 6 in the neighbourhood of the guide post 4 and protruded at a lower height than the linear rib 6. The pressure lands 7 are pressed against the cover parts b provided on the leg portions l of the fastener elements e. A leaf spring 8 with automatic stopping function is disposed on the inner face of the upper wing 2 so that the tip end of the leaf spring 8 serves as a stop claw 9.

On one hand, an opening 11 for the automatic stop claw 9 is disposed in the middle portion of the linear rib 6 and the pressure lands 7 on the inner face of the upper wing 2, and also arranged in a gap portion 10 of fastener elements e not engaged and immediately before the mutually engaged right and left fastener elements e. Accordingly, when a pull tab T of the slider is lifted up, the leaf spring 8 is pulled up to disengage the tip end or the stop claw 9 of the leaf spring 8 from the gap portion 10 of the fastener elements e so that the slider is able to slide. When the sliding of the slider is stopped, the stop claw 9 is automatically inserted into the gap portion 10 between non-engaged right and left fastener elements e under a resilient force of the leaf spring 8 to stop the slider so as to prevent the opening of the slide fastener chain.

When cover parts b such as blades and the like for covering the leg portions l of the fastener elements e are located on the inner face of the lower wing 3 of the slider body 1, a linear rib 12 is protruded from the lower wing 3 and pressed against the lower faces of coupling head portions of the fastener elements e.

Figure 5:
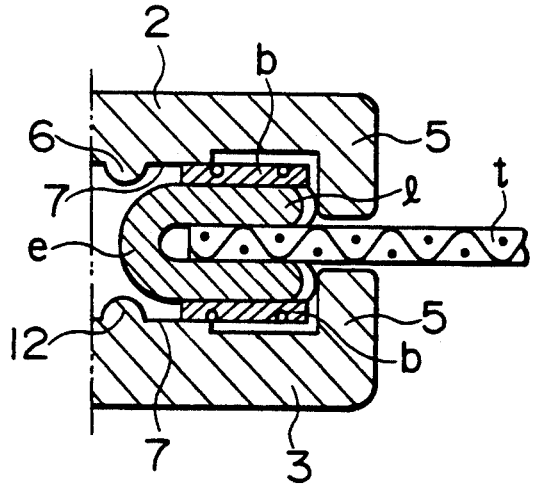
FIG. 5 is an end face view corresponding to FIG. 4 of the other slider.

The inner faces of the upper wing 2 and the lower wing 3 are symmetrically shaped. A linear rib 6 and pressure lands 7 arranged on both sides of the rib 6 are provided in the upper wing 2 and another linear rib 12 and pressure lands 7 arranged on both sides of the rib 12 are provided in the lower wing 3, as shown in FIG. 5. These linear ribs 6, 12 and pressure lands 7, 7 are respectively pressed against the cover parts b which are disposed on the leg portions l of the fastener elements e.

Figure 6:
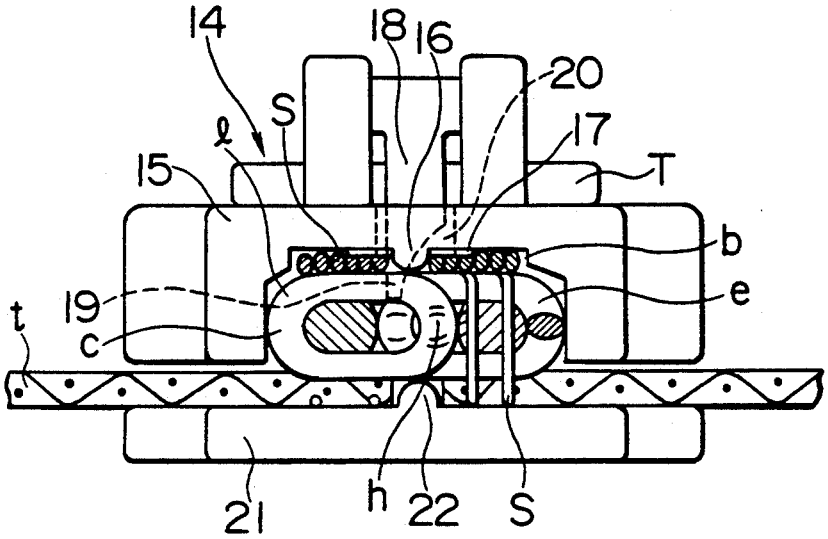
FIG. 6 is a front view of a slider in a coil type linear slide fastener.

A coil type slider for a linear slide fastener is shown in FIG. 6, wherein a coiled linear fastener element e of this slide fastener chain overlaps one side edge of a fastener tape t so that the leg portion l of the fastener element e is sewn onto the fastener tape t by a thread s, so that the surface of the leg portion l is covered with a sewing thread s which serves as the cover part b.

In the slider used in this slide fastener chain, a linear rib 16 is protruded on an inner face of an upper wing 15 of a slider body 14, and pressure lands 17 are provided at a lower height than the rib 16 on the both sides of the rib 16 in the neighbourhood of the guide post. The rib 16 slides along the upper face of the coupling head portion h of the fastener element e and the pressure lands 7 are pressed against a part of the sewing thread s exposed on the leg portion l of the fastener element e. A leaf spring 18 with automatic stop function is also disposed on the upper wing 15 as well as the first embodiment so that the tip end of the leaf spring 18 serves as a stop claw 19. The stop claw 19 is inserted into an opening 20 which is punched in the middle portion of the linear rib 16 and the pressure lands 17, and is moreover resiliently inserted into the gap portion of the fastener elements e not engaged and immediately before the mutually engaged right and left fastener elements e. A linear rib 22 is also protruded in the central longitudinal direction on the inner face of the lower wing 21 and pressed against the lower face of the coupling head portion h of the fastener element e. It is also possible to sew the blades onto both faces of the leg portions of the fastener elements with the sewing thread to cover the leg portions.

Figure 7:
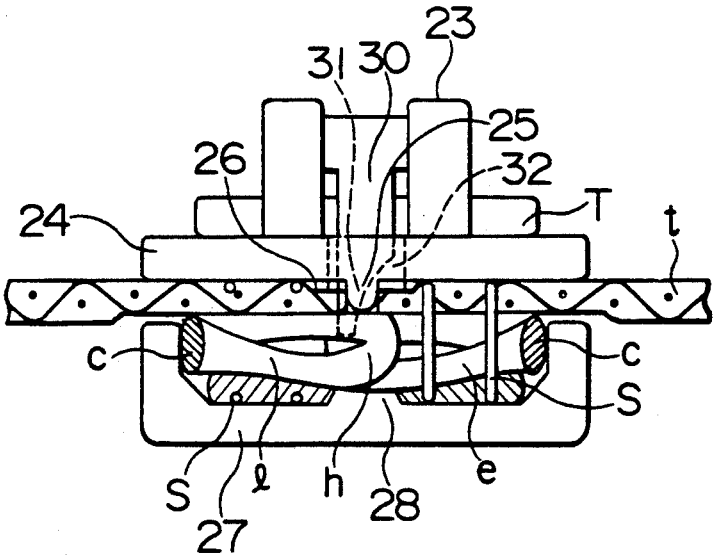
FIG. 7 is a front view of a slider in a coil type linear slide fastener covered by fastener tapes.

Finally, a covered slide fastener is shown in FIG. 7, wherein a coiled fastener element e is attached to a side edge of a fastener tape t on a back face thereof, and the fastener element e is not apparent from the front face thereof. In the slider used in this slide fastener chain, an upper wing 24 of a slider body 23 is comprised of a flat board, on which a linear rib 25 is protruded in a central longitudinal direction. Pressure lands 26 are formed at a lower height than the rib 25 on the both sides of the rib 25 in the neighbourhood of the guide post, and are pressed against the side edges of the fastener tapes t. A linear rib 28 is also provided in a central longitudinal direction on an inner face of a lower wing 27 and slides along the lower face of the coupling head portion h of the fastener element e. Flanges 29 are provided on both sides of the lower wing 27 to guide the connecting portions c of the fastener elements e.

Moreover, a leaf spring 30 with automatic stop function as well as the above-mentioned embodiments is provided on the surface of the upper wing 24. The tip end of the spring 30 is formed as a stop claw 31 and is inserted into an opening 32 which is punched in the middle portion of the linear rib 25 and the pressure lands 26. The tip end of the spring is also resiliently inserted into a gap portion of the fastener elements not engaged and immediately before the mutually engaged right and left fastener elements.

Furthermore, with the covered slide fastener chain, a linear fastener element e may be not only sewed onto one side edge of the fastener tape t, but also simultaneously woven in weaving of a fastener tape t to produce a slide fastener chain.

According to this invention, a slider having an automatic stop means may be used in a linear slide fastener having a covered leg portion of a fastener element. Since the linear rib and the pressure lands are disposed on the inner face of the upper wing, the pressure lands are pressed against the cover parts which cover the fastener elements. As a result, the non-engaged fastener elements facing the pressure lands are prevented from deforming to maintain the fastener elements stably. Even when the stop claw is inserted into the gap portion of the fastener elements and a deforming force is applied to the fastener elements, the fastener elements are prevented from deforming so that a slider having a durable automatic stop means to stop the slider reliably is produced easily.

Furthermore, according to this invention, the slider having the automatic stop means may be easily used in the linear slide fastener with covered fastener elements, and as a result, it leads slide fastener with covered elements to be widely applied.

While preferred embodiment of this invention have been described using specific terms, such descriptions are for illustrative purpose only, and it is to be understood that changes and variations may be made without departing from the spirit or scope of the following claims.

What is claimed is:

1. A slider for a linear slide fastener having covered leg portions of fastener elements and coupling head portions of the fastener elements connected thereto, said slider including an automatic stop claw, a slider body which has an upper wing and a lower wing interconnected by a guide post, and a pull tab, comprising: a linear rib being protruded in a central longitudinal direction on an inner face of said upper wing of said slider body, pressure lands being provided at a lower height than said rib on both sides of said rib in the neighborhood of said guide post, to prevent the non-engaged fastener elements facing said pressure lands from deforming which maintains the fastener elements stability, and an opening for said automatic stop claw being punched in a middle portion of said rib and said pressure lands.

2. A slider according to claim 1, wherein said opening for said stop claw are punched in said slider body at a position where said stop claw is inserted into a gap portion of said fastener elements not engaged and immediately before mutually engaged right and left fastener elements.

3. A slider according to claim 1, wherein said linear rib is pressible against upper faces of said coupling head portions, and further comprising a second linear rib located in a central longitudinal direction on an inner face of said lower wing and pressible against lower faces of said coupling head portions of said fastener elements.

4. A slider according to claim 3 further comprising second pressure lands provided at a lower height than said second linear rib and extending laterally on both sides of said rib in the neighborhood of said guidepost.

5. A slider for a linear slide fastener having leg portions of fastener elements covered by cover parts, said slider including an automatic stop claw, a slider body which has an upper wing and a lower wing interconnected by a guide post, and a pull tab, comprising: a linear rib being protruded in central longitudinal direction on an inner face of said upper wing of said slider body, pressure lands being provided at a lower height than said rib on both sides of said rib in the neighborhood of said guide post, and an opening for said automatic stop claw being punched in a middle portion of said rib and said pressure lands;

wherein said pressure lands provided on said slider body are pressed against said cover parts covering said leg portions of said fastener elements, said linear rib provided on the inner face of said upper wing is pressed against the upper faces of coupling head portions of said fastener elements, and another linear rib is also provided in a central longitudinal direction on an inner face of said lower wing and pressed against the lower faces of said coupling head portions of said fastener elements.

6. A slider for a linear slide fastener having leg portions of fastener elements covered by cover parts, said slider including an automatic stop claw, a slider body which has an upper wing and a lower wing interconnected by a guide post, and a pull tab, comprising: a linear rib being protruded in a central longitudinal direction of an inner face of said upper wing of said upper wing of said slider body, pressure lands being provided at a lower height than said rib on both sides of said rib in the neighbourhood of said guide post, and an opening for said automatic stop claw being punched in a middle portion of said rib and said pressure lands;

wherein said opening for said stop claw is punched in said slider body at a position where said stop claw is inserted into a gap portion of said fastener elements not engaged and immediately before mutually engaged right and left fastener elements; and wherein said pressure lands provided on said slider body are pressed against said cover parts covering said leg portions of said fastener elements, said linear rib provided on the inner face of said upper wing is pressed against the upper faces of coupling head portions of said fastener elements, and another linear rib is also provided in a central longitudinal direction on an inner face of said lower wing and pressed against the lower faces of said coupling head portions of said fastener elements.

* * * * *